US010535948B2

(12) United States Patent
Mori

(10) Patent No.: US 10,535,948 B2
(45) Date of Patent: Jan. 14, 2020

(54) FITTING CONNECTOR

(71) Applicant: Yazaki Corporation, Tokyo (JP)

(72) Inventor: Yuki Mori, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/409,747

(22) Filed: May 10, 2019

(65) Prior Publication Data

US 2019/0348790 A1 Nov. 14, 2019

(30) Foreign Application Priority Data

May 14, 2018 (JP) ..... 2018-092790

(51) Int. Cl.
*H01R 13/187* (2006.01)
*H01R 13/44* (2006.01)
*H01R 13/11* (2006.01)

(52) U.S. Cl.
CPC ..... *H01R 13/44* (2013.01); *H01R 13/111* (2013.01)

(58) Field of Classification Search
CPC .... H01R 13/187; H01R 13/18; H01R 23/727; H01R 13/20; H01R 13/15
USPC ..... 439/843, 839, 844–847
See application file for complete search history.

(56) References Cited

U.S. PATENT DOCUMENTS

| | | | | |
|---|---|---|---|---|
| 7,467,980 | B2 * | 12/2008 | Chiu | H01R 13/18 439/843 |
| 7,789,721 | B1 * | 9/2010 | Burdenko | H01R 13/111 439/851 |
| 8,317,552 | B2 * | 11/2012 | Leroyer | H01R 13/111 439/839 |
| 9,009,960 | B2 * | 4/2015 | Vaccaro | H01R 13/111 29/874 |
| 9,431,741 | B2 * | 8/2016 | Takahashi | H01R 13/187 |
| 9,787,012 | B2 * | 10/2017 | Kawaguchi | H01R 13/03 |
| 9,917,399 | B2 * | 3/2018 | Gessford | H01R 13/6271 |
| 2017/0244196 | A1 | 8/2017 | Ilie | |
| 2019/0229461 | A1 | 7/2019 | Lu et al. | |

FOREIGN PATENT DOCUMENTS

| | | | |
|---|---|---|---|
| EP | 3208892 | A1 | 8/2017 |
| JP | 8-78079 | A | 3/1996 |
| WO | 2017/223416 | A1 | 12/2017 |

* cited by examiner

*Primary Examiner* — Phuong Chi Thi Nguyen
(74) *Attorney, Agent, or Firm* — Kenealy Vaidya LLP

(57) ABSTRACT

A fitting connector includes a female connector provided with a female terminal and a female-side insulating member, and a male connector provided with a male terminal and a male-side insulating member. The male-side connecting body has a male-side space part into which an inner cylindrical body in a cylindrical shape having insulating property is inserted on the same cylindrical axis, and the female-side insulating member has a finger touch preventing body having a columnar or cylindrical shape arranged in the female-side space part on the same axis line as the cylindrical axis of the female-side space part, and inserted into a first space part formed inside the outer cylindrical body and a second space part formed inside the inner cylindrical body when the female-side connecting body and the male-side connecting body are in an inserted and fitted state.

8 Claims, 13 Drawing Sheets

FITTING CONNECTOR

CROSS-REFERENCE TO RELATED APPLICATION(S)

The present application claims priority to and incorporates by reference the entire contents of Japanese Patent Application No. 2018-092790 filed in Japan on May 14, 2018.

BACKGROUND OF THE INVENTION

1. Field of the Invention

The present invention relates to a fitting connector.

2. Description of the Related Art

Conventionally, a fitting connector including a female connector that is provided with a female terminal and a male connector that is provided with a male terminal, in which a fitting of the female connector and the male connector physically and electrically connects the female terminal and the male terminal, has been known. In the fitting connector, the female connector includes the female terminal having a cylindrical shape, and a female-side insulating member that is arranged inside the female terminal. The female-side insulating member is provided so as to prevent fingers from touching the female terminal, and is arranged while being formed in, for example, a columnar shape. In addition, in the fitting connector, the male connector includes the male terminal to be inserted into and fitted with the female terminal, and a male-side insulating member that covers a tip surface of the male terminal. The male-side insulating member is provided so as to prevent fingers from touching the tip of the male terminal. The male terminal and the male-side insulating member are formed to have a space part for allowing the female-side insulating member to be inserted therein when the female connector and the male connector are in a fitted state. A fitting connector of this type is disclosed in, for example, Japanese Patent Application Laid-open No. 8-78079.

Meanwhile, in the conventional fitting connector, the male terminal and the female-side insulating member come into contact with each other when the male connector is inserted into and extracted from the female connector, and the female-side insulating member, which is made of a synthetic resin material or the like, may be scraped by the male terminal, which is made of metal. The shavings of the female-side insulating member may cause conduction failure between the female terminal and the male terminal by going into a fitting portion therebetween.

SUMMARY OF THE INVENTION

An object of the present invention is to provide a fitting connector that is capable of suppressing degradation of conduction performance between female and male terminals.

In order to achieve the above mentioned object, a fitting connector according to one aspect of the present invention includes a female connector that is provided with a female terminal and a female-side insulating member having insulating property; and a male connector that is provided with a male terminal and a male-side insulating member having insulating property, wherein the female terminal has a female-side connecting body having a cylindrical shape, where a female-side space part is formed inside, the male terminal has a male-side connecting body having a cylindrical shape to be inserted into and fitted with the female-side space part on a same cylindrical axis, the male-side insulating member has an outer cylindrical body having a cylindrical shape that covers a tip surface of the male-side connecting body on a connector insertion direction side, on the same cylindrical axis, the male-side connecting body has, in inside thereof, a male-side space part into which an inner cylindrical body having a cylindrical shape and insulating property is inserted on the same cylindrical axis, and the female-side insulating member has a finger touch preventing body having a columnar or cylindrical shape that is arranged in the female-side space part on the same axis line as the cylindrical axis of the female-side space part, and that is inserted into a first space part formed inside the outer cylindrical body and a second space part formed inside the inner cylindrical body, when the female-side connecting body and the male-side connecting body are in an inserted and fitted state.

According to another aspect of the present invention, in the fitting connector, it is desirable that the inner cylindrical body is integrated with the outer cylindrical body.

According to still another aspect of the present invention, in the fitting connector, it is desirable that a length of the inner cylindrical body in the cylindrical axis direction is a length that causes a tip of the finger touch preventing body on the connector insertion direction side to be arranged in the second space part when the female-side connecting body and the male-side connecting body are in the inserted and fitted state.

According to still another aspect of the present invention, in the fitting connector, it is desirable that the finger touch preventing body is further projected than the tip surface of the female-side connecting body on the connector insertion direction side, in the axis line direction, and in the female connector, an annular body having insulating property that is further projected than the tip surface of the female-side connecting body on the same cylindrical axis is provided outside the female-side space part in an orthogonal direction with respect to the cylindrical axis direction of the female-side connecting body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a fitting connector according to the present invention will be described in detail based on the drawings. The present invention is not limited to this embodiment.

Embodiment

An embodiment of a fitting connector according to the present invention will be described based on FIG. 1 to FIG. 15.

Figure 1:
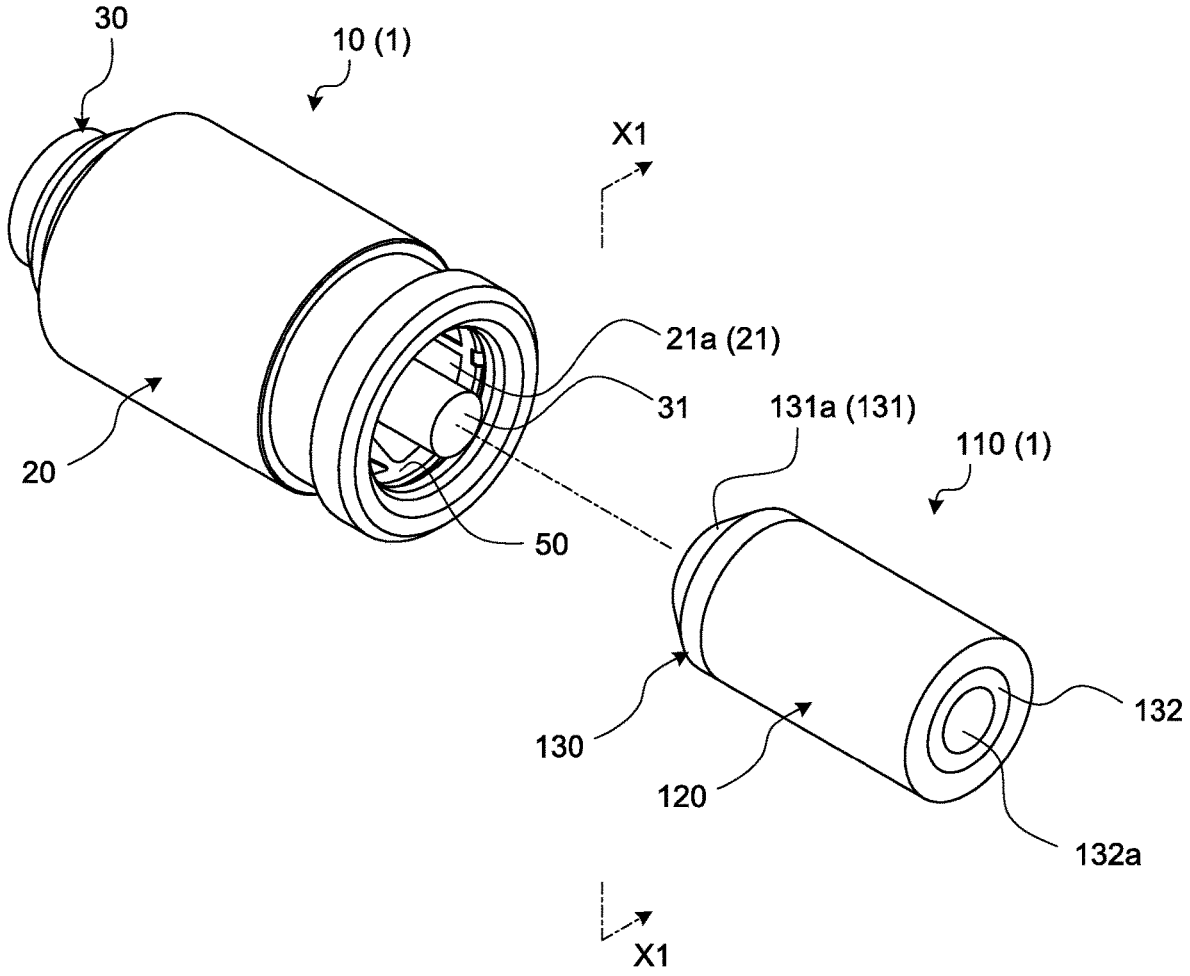
FIG. 1 is a perspective view illustrating a fitting connector in an extracted state according to an embodiment.
Figure 2:
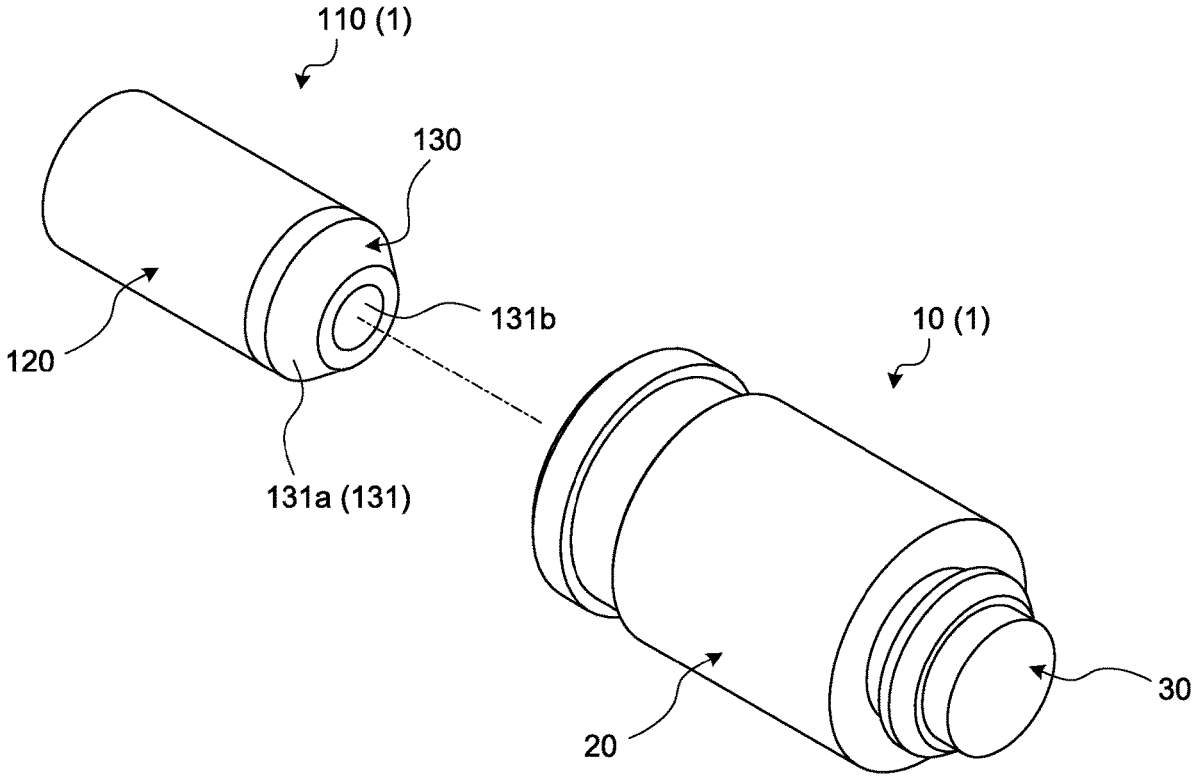
FIG. 2 is a perspective view illustrating the fitting connector in the extracted state according to the embodiment seen from another angle.
Figure 3:
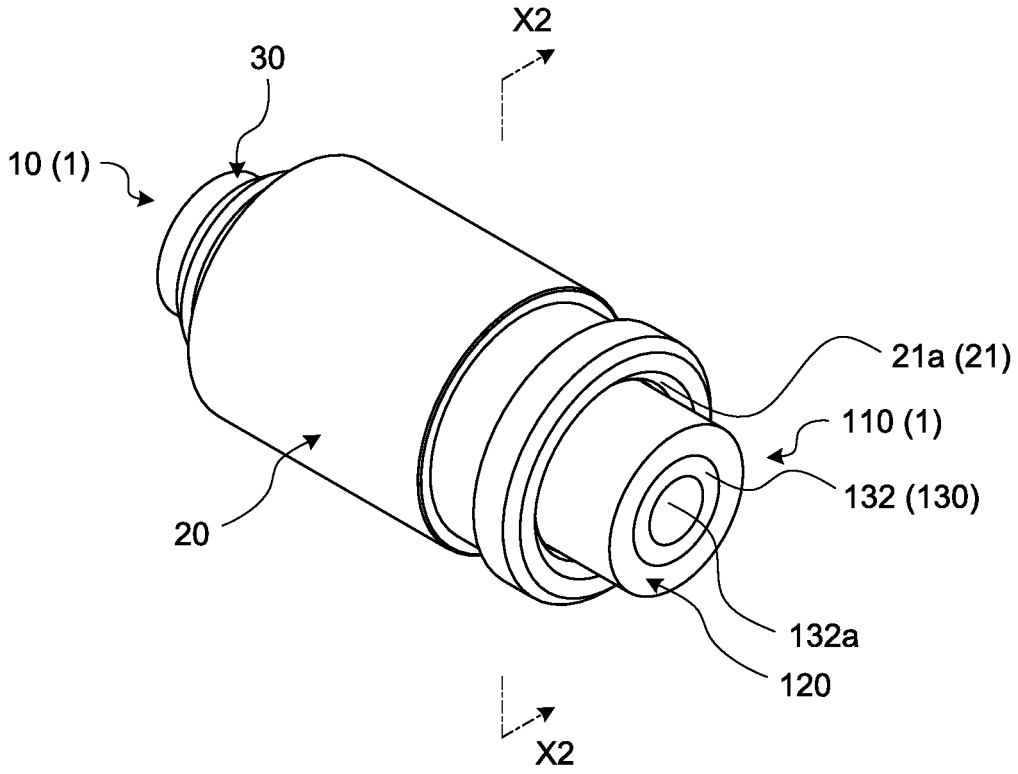
FIG. 3 is a perspective view illustrating the fitting connector in an inserted and fitted state according to the embodiment.

Reference sign 1 in FIG. 1 to FIG. 3 denotes the fitting connector in the present embodiment. The fitting connector 1 is what is called a female and male connector, and it includes a female connector 10 (FIG. 1 to FIG. 4) that is provided with a female terminal 20 and a female-side insulating member 30 having insulating property, and a male connector 110 (FIG. 1 to FIG. 3, and FIG. 5) that is provided with a male terminal 120 and a male-side insulating member 130 having insulating property. For convenience of explanation, a female housing 40 and a male housing 140, which will be described later, are omitted in each of the drawings.

In the fitting connector 1, the female connector 10 and the male connector 110 are fitted in accordance with an insertion operation performed therebetween, and by inserting the male terminal 120 into and fitting the male terminal 120 with the female terminal 20 in conjunction with that insertion and fitting, the female terminal 20 and the male terminal 120 are physically and electrically connected (FIG. 3). On the other hand, in the fitting connector 1, the female connector 10 and the male connector 110 are separated from each other in accordance with an extraction operation therebetween, and as a result, the female terminal 20 and the male terminal 120 are physically and electrically disconnected (FIG. 1 and FIG. 2). The insertion and fitting direction and the extraction direction are opposite from each other. In the following descriptions, the insertion and fitting direction will be described as the "connector insertion direction", and the extraction direction will be described as the "connector extraction direction". Each of these directions indicates the direction at the time of insertion and extraction of a connector that is regarded as a subject, with respect to its fitting connector.

First, the female connector 10 will be described.

Figure 6:
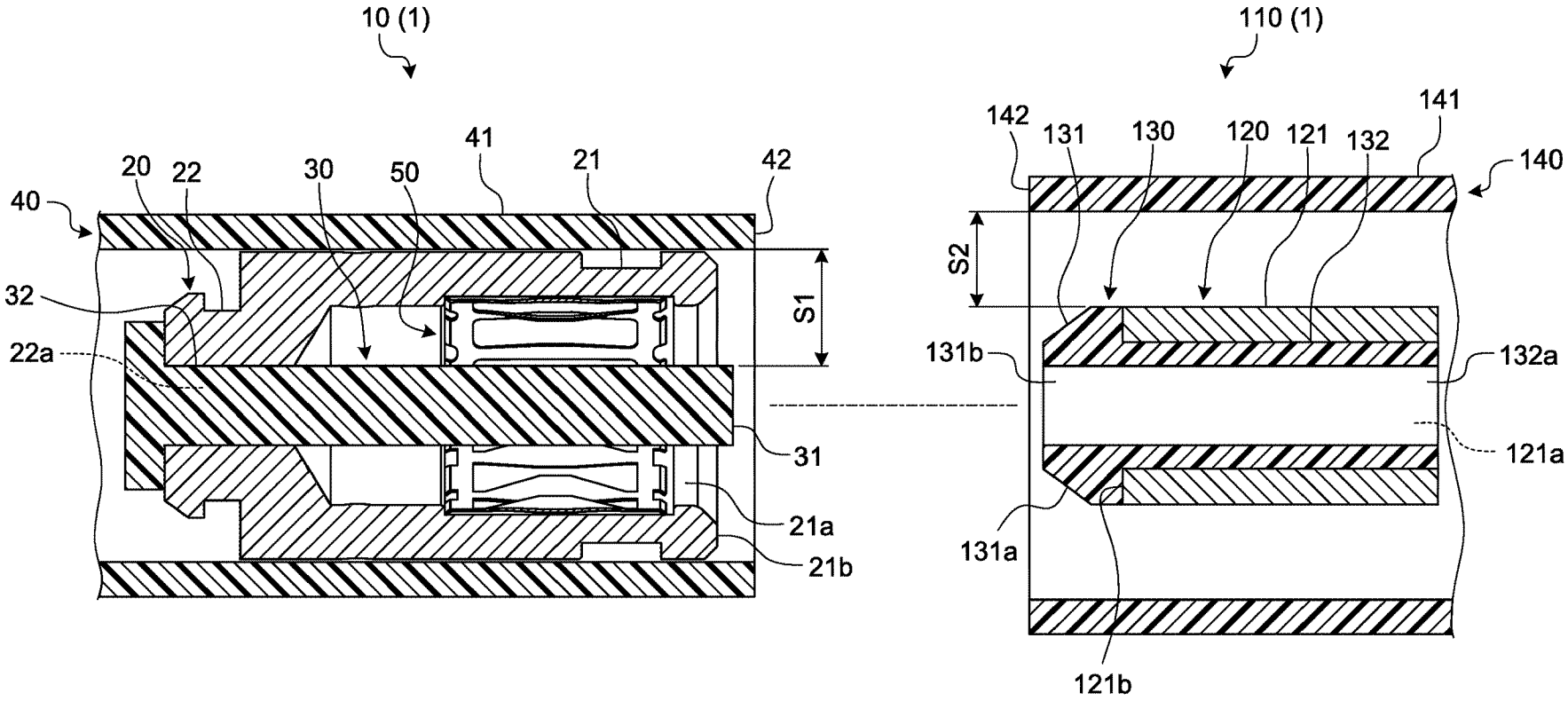
FIG. 6 is a cross-sectional view along line X1-X1 in FIG. 1.
Figure 7:
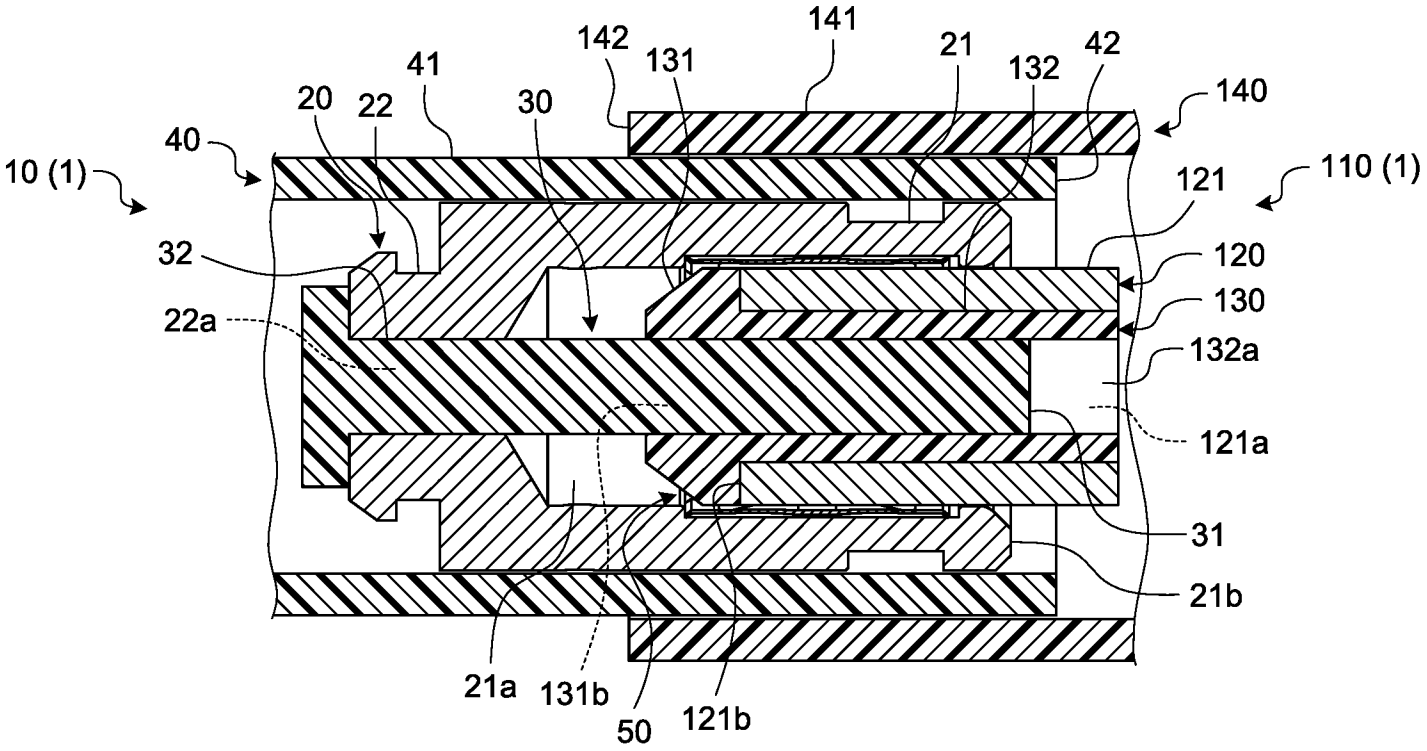
FIG. 7 is a cross-sectional view along line X2-X2 in FIG. 3.

The female connector 10 includes, besides the female terminal 20 and the female-side insulating member 30, the female housing 40 for containing them (FIG. 6 and FIG. 7).

The female terminal 20 is made of a conductive material such as metal. The female terminal 20 has a female-side connecting body 21 having a cylindrical shape, in which a female-side space part 21*a* is formed (FIG. 2, FIG. 4, FIG. 6, and FIG. 7). Furthermore, the female terminal 20 has a container 22 having a cylindrical shape that contains and holds the female-side insulating member 30 in a containing space part 22*a* formed inside (FIG. 6 and FIG. 7). In the female terminal 20, the female-side connecting body 21 and the container 22 are arranged in parallel on the same cylindrical axis. Here, the female-side connecting body 21 and the container 22 are adjacent on the same cylindrical axis. In this exemplification, the female-side connecting body 21 and the container 22 are formed in cylindrical shapes.

With respect to the female-side space part 21*a* of the female-side connecting body 21, a male-side connecting body 121, which will be described later, of the male terminal 120 is inserted and fitted on the same cylindrical axis. The female terminal 20 and the male terminal 120 are physically and electrically connected by the female-side connecting body 21 and the male-side connecting body 121 that are in an inserted and fitted state.

Figure 4:
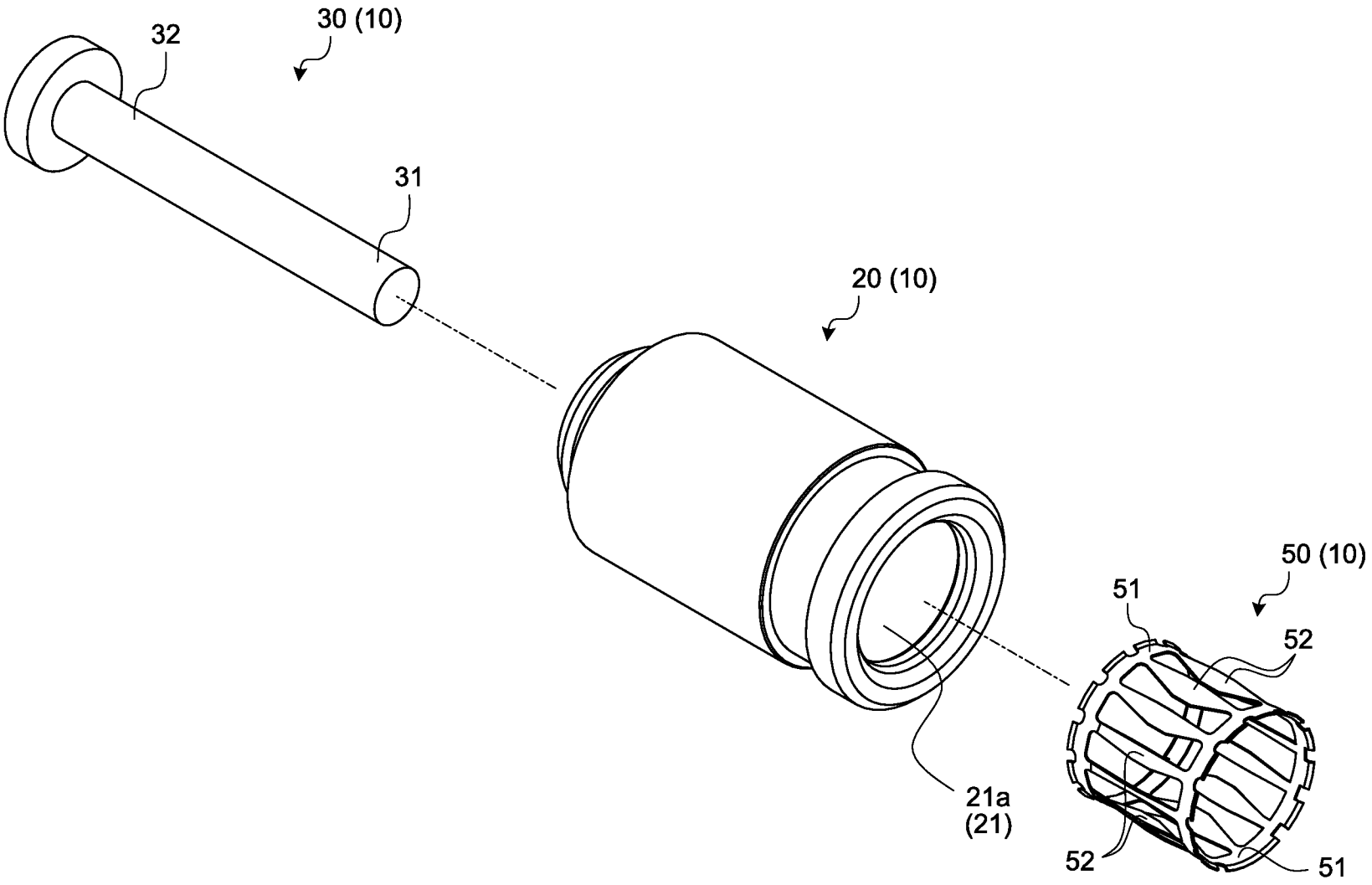
FIG. 4 is an exploded perspective view of a female connector.

In this exemplification, a contact member 50 (FIG. 2, FIG. 4, FIG. 6, and FIG. 7) is interposed between the female-side connecting body 21 and the male-side connecting body 121, and the female-side connecting body 21 and the male-side connecting body 121 are physically and electrically connected through the contact member 50. The contact member 50 has two annular parts 51 that are arranged on the same axis line with an interval from each other, and a plurality of contact parts 52 that connect those two annular parts 51 (FIG. 4). The two annular parts 51 of the contact member 50 come into contact with an inner peripheral surface of the female-side space part 21*a* and are held by the inner peripheral surface, thereby allowing the male-side connecting body 121 to connect to the female-side connecting body 21 physically and electrically. The annular parts 51 in this exemplification are formed in annular shapes. The contact parts 52 are each arranged around the axis. The contact parts 52 each have spring property, and they generate resilient force as reaction force by being pressed by the male-side connecting body 121 that has been inserted. The contact member 50 utilizes the spring property of each of the contact parts 52 so as to allow the female-side connecting body 21 to physically and electrically connect to the male-side connecting body 121.

The female-side insulating member 30 is made of an insulating material such as synthetic resin. The female-side insulating member 30 is a member for preventing fingers from touching the female terminal 20, in conjunction with the female housing 40. The female-side insulating member 30 is contained in the female-side space part 21*a* and the containing space part 22*a*, which are formed inside the female terminal 20. The female-side insulating member 30 has a finger touch preventing body 31 having a columnar or cylindrical shape that is arranged in the female-side space part 21*a* on the same axis line as the cylindrical axis of the female-side space part 21*a* (FIG. 2, FIG. 4, FIG. 6, and FIG. 7). Furthermore, the female-side insulating member 30 has an object to be contained 32 having a columnar or cylindrical shape that is contained in the containing space part 22*a* on the same axis line as the cylindrical axis of the containing space part 22*a* (FIG. 4, FIG. 6, and FIG. 7). In this exemplification, the finger touch preventing body 31 and the object to be contained 32 are formed in columnar shapes.

The finger touch preventing body 31 is formed such that its outer diameter is smaller than an inner diameter of the female-side space part 21*a*. In this manner, the finger touch preventing body 31 forms a cylindrical space between itself and the inner peripheral surface of the female-side space part 21*a*. The male-side connecting body 121 is inserted into the cylindrical space. Thus, the finger touch preventing body 31 is inserted into a male-side space part 121*a*, which will be described later, that is formed inside the male-side connecting body 121, when the female-side connecting body 21 and the male-side connecting body 121 are in the inserted and fitted state.

Figure 8:
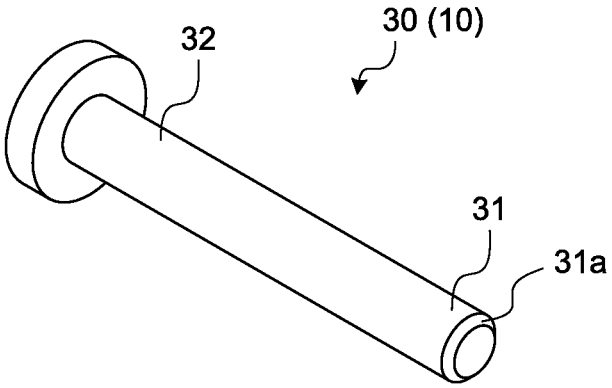
FIG. 8 is a perspective view illustrating a deformed form of a finger touch preventing body.
Figure 9:
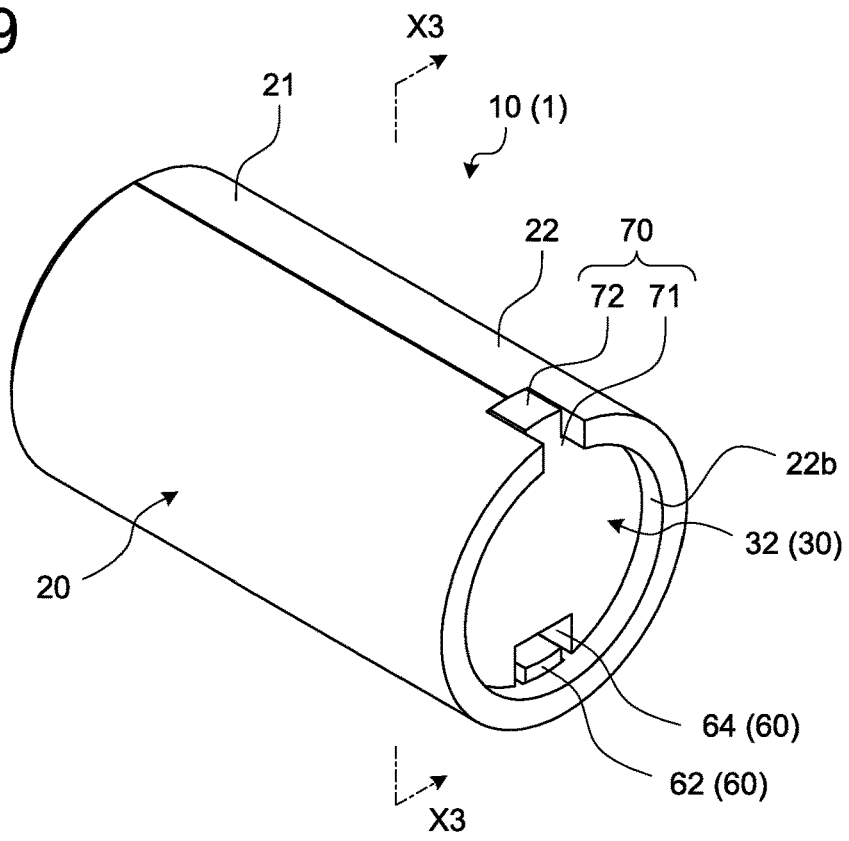
FIG. 9 is a perspective view illustrating the female connector that is provided with a fixing structure.
Figure 10:
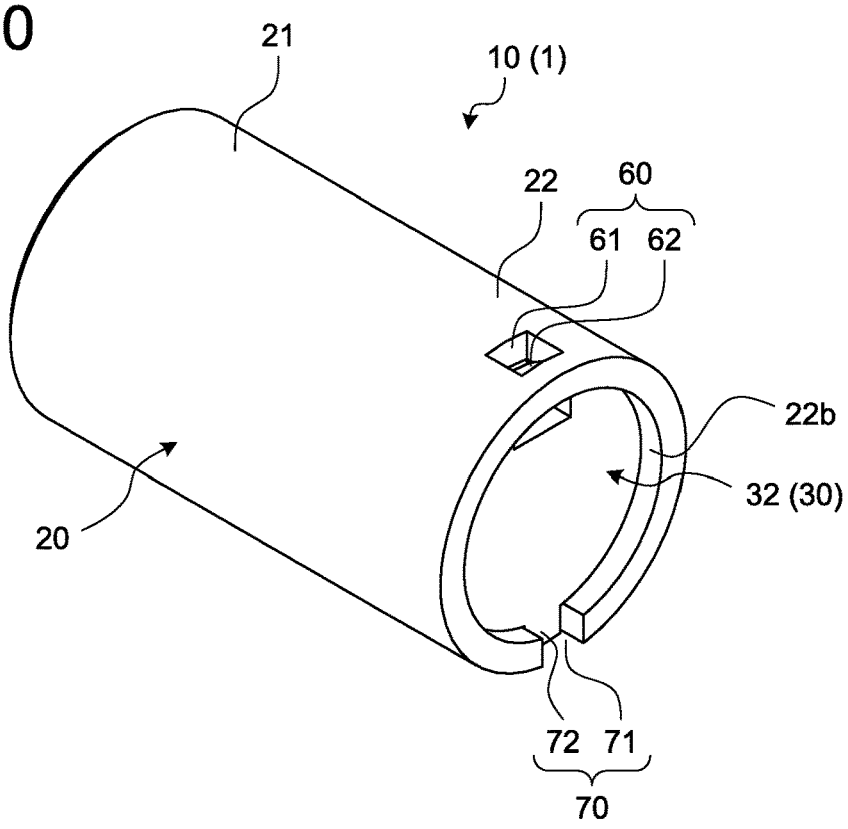
FIG. 10 is a perspective view of the female connector that is provided with the fixing structure, seen from another angle.
Figure 11:
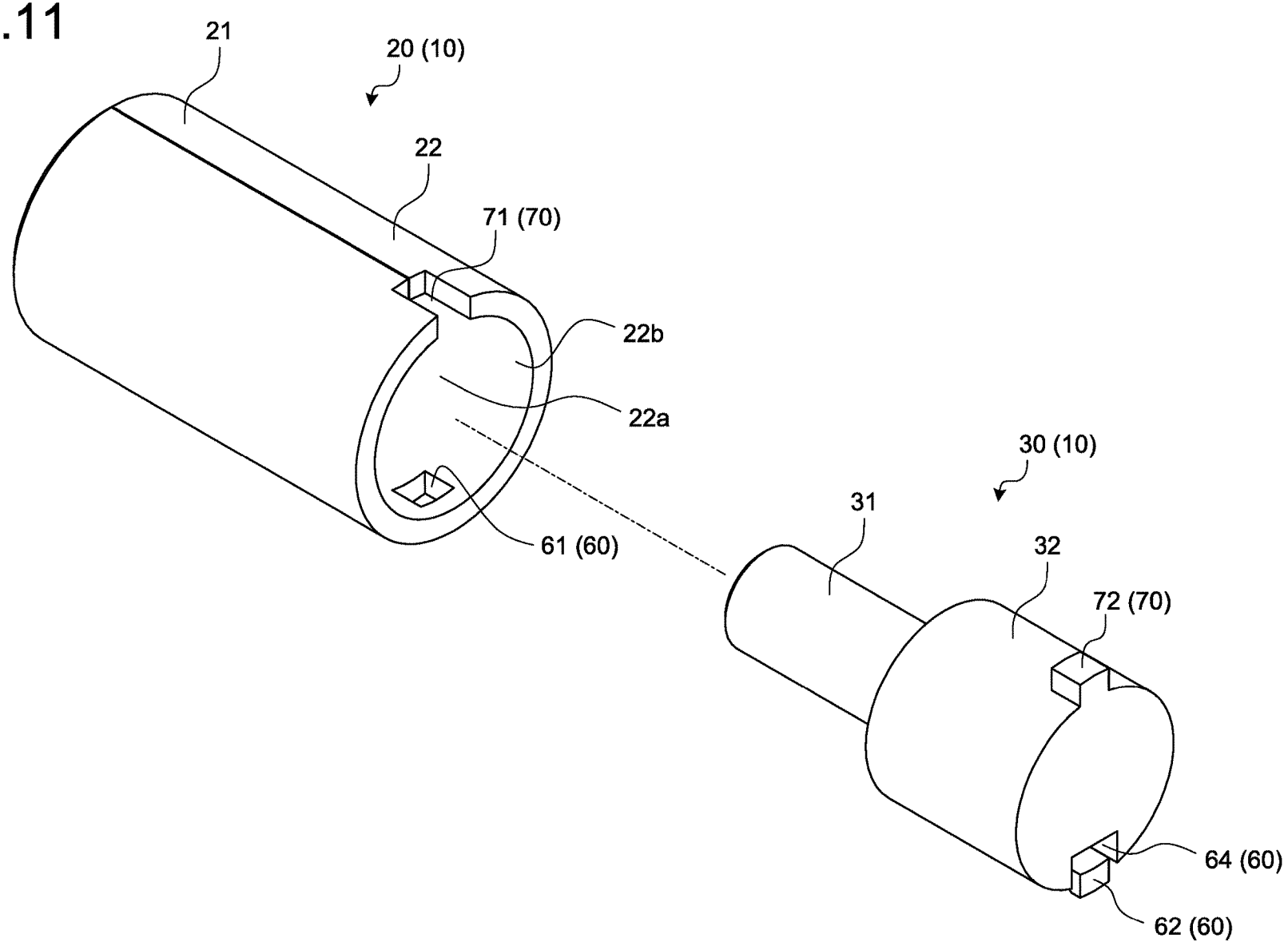
FIG. 11 is an exploded perspective view illustrating the female connector that is provided with the fixing structure.

Specifically, the finger touch preventing body 31 in this exemplification is inserted into a first space part 131*b* that is formed inside an outer cylindrical body 131, which will be described later, and a second space part 132*a* that is formed inside an inner cylindrical body 132, which will be described later, when the female-side connecting body 21 and the male-side connecting body 121 are in the inserted and fitted state. The finger touch preventing body 31 is inserted into the first space part 131*b* from its tip on the connector insertion direction side, and it reaches the second space part 132*a*. Thus, in the finger touch preventing body 31, a chamfered part 31*a* having an annular shape along the circumferential direction is desirably provided at the tip on the connector insertion direction side, so as to facilitate the insertion into the first space part 131*b* (FIG. 8). The chamfered part 31*a* may be a curved surface or flat surface. The chamfered part 31*a* in this exemplification is formed in a tapered shape.

For example, the female-side insulating member 30 may be integrally formed (e.g., insert molding) with the female terminal 20 that is placed in a mold. The female-side insulating member 30 illustrated in each of the drawings so far is made by such integral molding.

On the other hand, the female-side insulating member 30 may be formed separately from the female terminal 20, and assembly with the female terminal 20 may be performed by inserting the finger touch preventing body 31 into the female-side space part 21*a* of the female-side connecting body 21 and inserting the object to be contained 32 into the containing space part 22*a* of the container 22. At the time of the assembly, for example, the object to be contained 32 is fitted into the containing space part 22*a*. FIG. 9 to FIG. 13 illustrate the female connector 10 in this case. Here, in the female connector 10, upon assembling the female terminal 20 and the female-side insulating member 30, formed separately, the female-side insulating member 30 is inserted into the female terminal 20 from the container 22 side. In the container 22, an opening on the opposite side of the female-side connecting body 21 is utilized as an insertion opening 22*b* for the female-side insulating member 30 (FIG. 9 to FIG. 13). The female-side insulating member 30 is inserted into the insertion opening 22*b* from the finger touch preventing body 31 side.

When assembling the separately formed female terminal 20 and female-side insulating member 30, the assembly is performed such that a relative positional relation therebetween corresponds to an intended completely contained position, after the insertion of the female-side insulating member 30. The intended completely contained position is a contained position of the female-side insulating member 30 with respect to the female terminal 20 that can secure a function (at least the finger touch preventing function) required for the female-side insulating member 30. In order to enable such assembly, in the female connector 10, a fixing structure 60 that fixes the container 22 and the object to be contained 32 in the completely contained position may be provided therebetween (FIG. 9 to FIG. 13).

For example, the fixing structure 60 is configured to include a first fixing part 61 that is provided in the container 22 and a second fixing part 62 that is provided in the object to be contained 32 (FIG. 10 to FIG. 13). The fixing structure 60 fixes the container 22 and the object to be contained 32 at the completely contained position by engaging the first fixing part 61 with the second fixing part 62. For example, either of the first fixing part 61 and the second fixing part 62 is formed as a fixing projection part that is projected in an orthogonal direction with respect to the axis line direction of the container 22 and the object to be contained 32. Furthermore, the other of the two is formed as a locking part in a through-hole shape or concave shape, into which the fixing projection part is inserted such that the fixing projection part is locked in each of the axis line direction and the circumferential direction of the container 22 and the object to be contained 32. In this exemplification, the first fixing part 61 is formed as the locking part, and the second fixing part 62 is formed as the fixing projection part.

Figure 12:
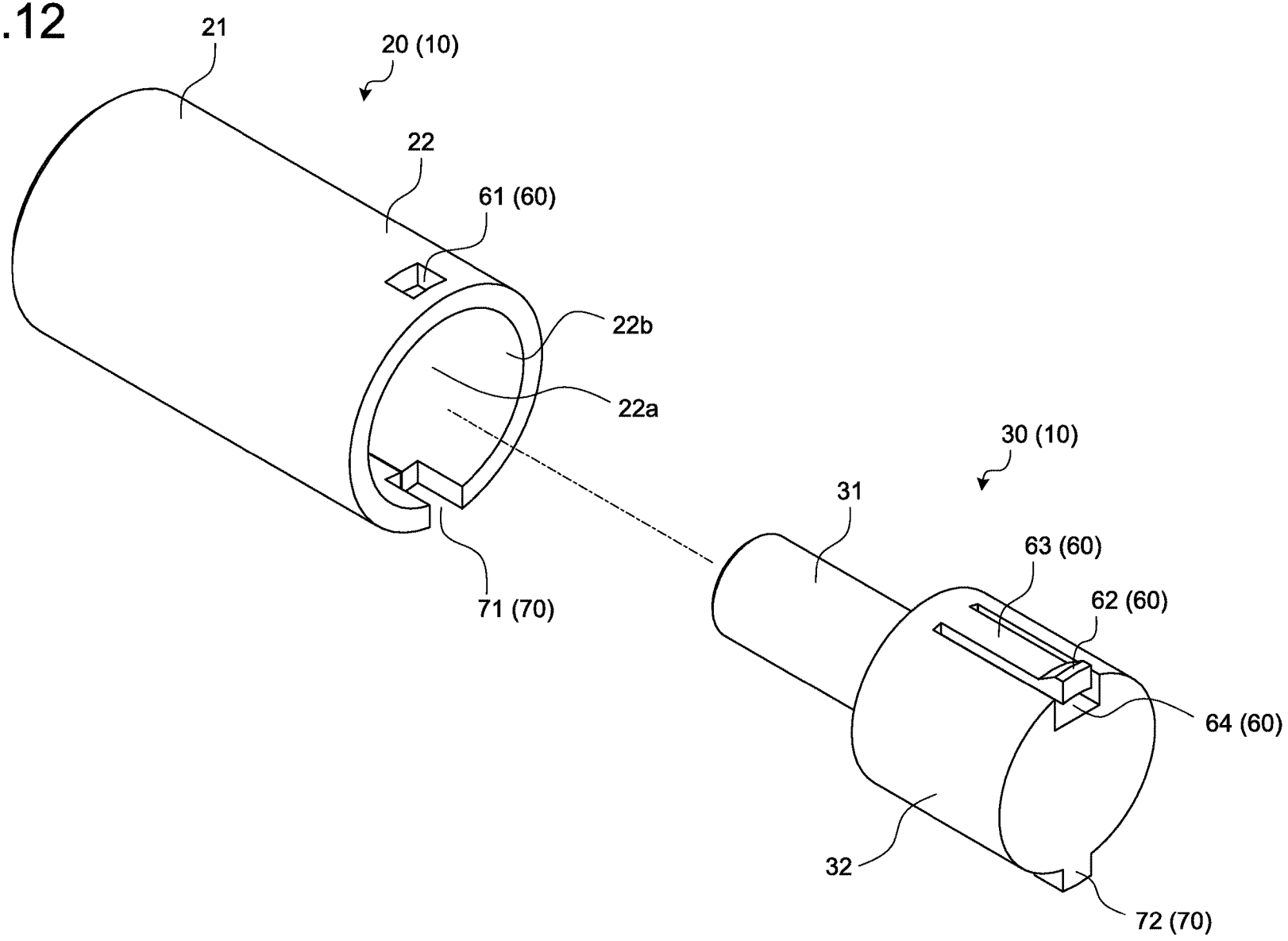
FIG. 12 is an exploded perspective view of the female connector that is provided with the fixing structure, seen from another angle.
Figure 13:
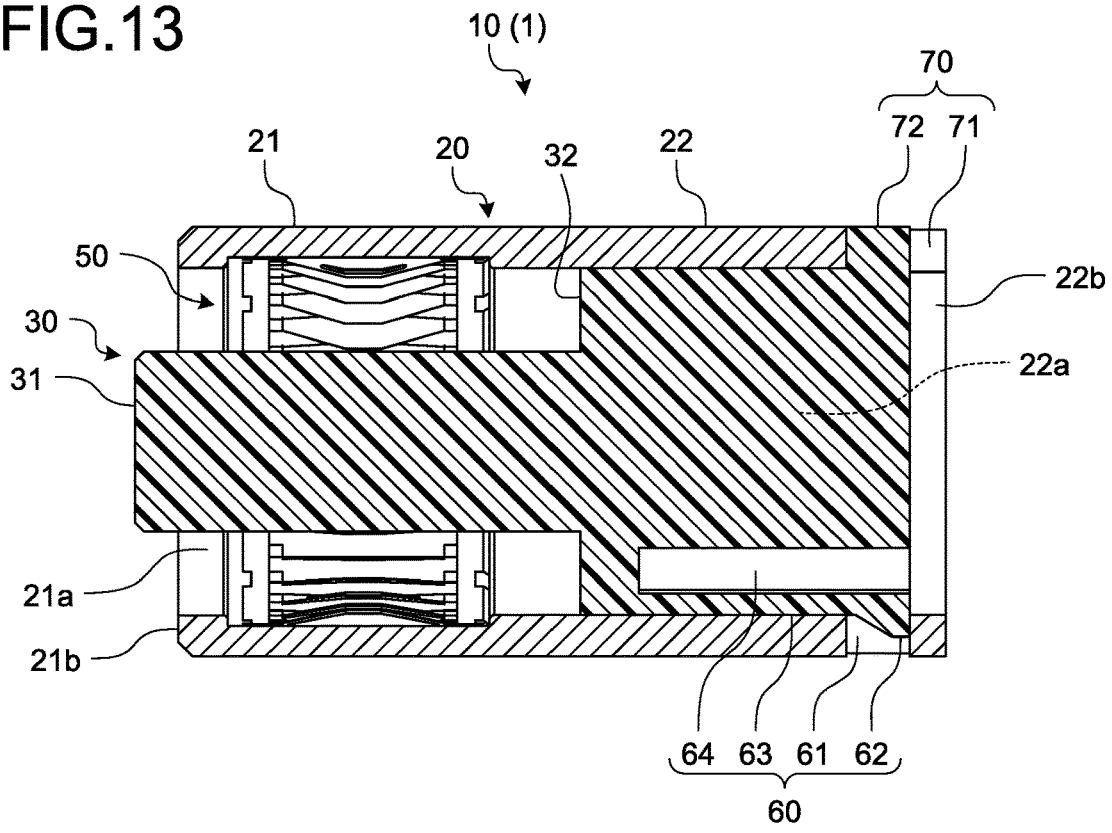
FIG. 13 is a cross-sectional view along line X3-X3 in FIG. 9.

The second fixing part 62 in this exemplification is provided at a free end of a flexible piece part 63 having flexibility (FIG. 12 and FIG. 13). In the flexible piece part 63, a fixed end and the free end are provided in the axis line direction of the object to be contained 32. The object to be contained 32 has a retreat space 64 for retreating the second fixing part 62 when the flexible piece part 63 is bent to the inner side in the radial direction. The second fixing part 62 retreats to the retreat space 64 with a bending of the flexible piece part 63 while being pushed by the inner peripheral surface of the containing space part 22*a*, and the second fixing part 62 is inserted into the first fixing part 61 with the elimination of the bending of the flexible piece part 63 at the completely contained position.

In the female connector 10, the female-side insulating member 30 is inserted from the insertion opening 22*b* of the container 22 so as to allow the first fixing part 61 to engage with the second fixing part 62 at the completely contained position. In the fixing structure 60, when the female-side insulating member 30 reaches the completely contained position, the second fixing part 62 as the fixing projection part is inserted into the first fixing part 61 as the locking part having a through-hole shape or concave shape.

Due to the fixing function of the fixing structure 60, in the female connector 10, the separately formed female terminal 20 and female-side insulating member 30 can be assembled such that the relative positional relation corresponds to the intended completely contained position. Thus, the female connector 10 in the present embodiment can ensure the finger touch prevention function with respect to the female terminal 20. In addition, in the female connector 10, since the female-side insulating member 30 and the female terminal 20 can be assembled at the completely contained position, it can also ensure an aligning function, which will be described later. Furthermore, since the female connector 10 can maintain the relative positional relation between the female terminal 20 and the female-side insulating member 30 using the fixing structure 60, it can continuously maintain the finger touch prevention function and the aligning function with respect to the female terminal 20, after the fitting of the connector (after attaching the male connector 110) and also after the extraction of the connector (after removing the male connector 110).

In addition, in the female connector 10, since the separately formed female terminal 20 and female-side insulating member 30 can be assembled such that the relative positional relation corresponds to the intended completely contained position, the assembling workability can be improved. In this manner, in the female connector 10, for example, it is possible to avoid a false recognition in which the female terminal 20 and the female-side insulating member 30 are recognized as being assembled before the female-side insulating member 30 has reached the completely contained position. In addition, in the female connector 10, it is also possible to avoid a deeper insertion of the female-side insulating member 30 beyond the completely contained position.

Figure 14:
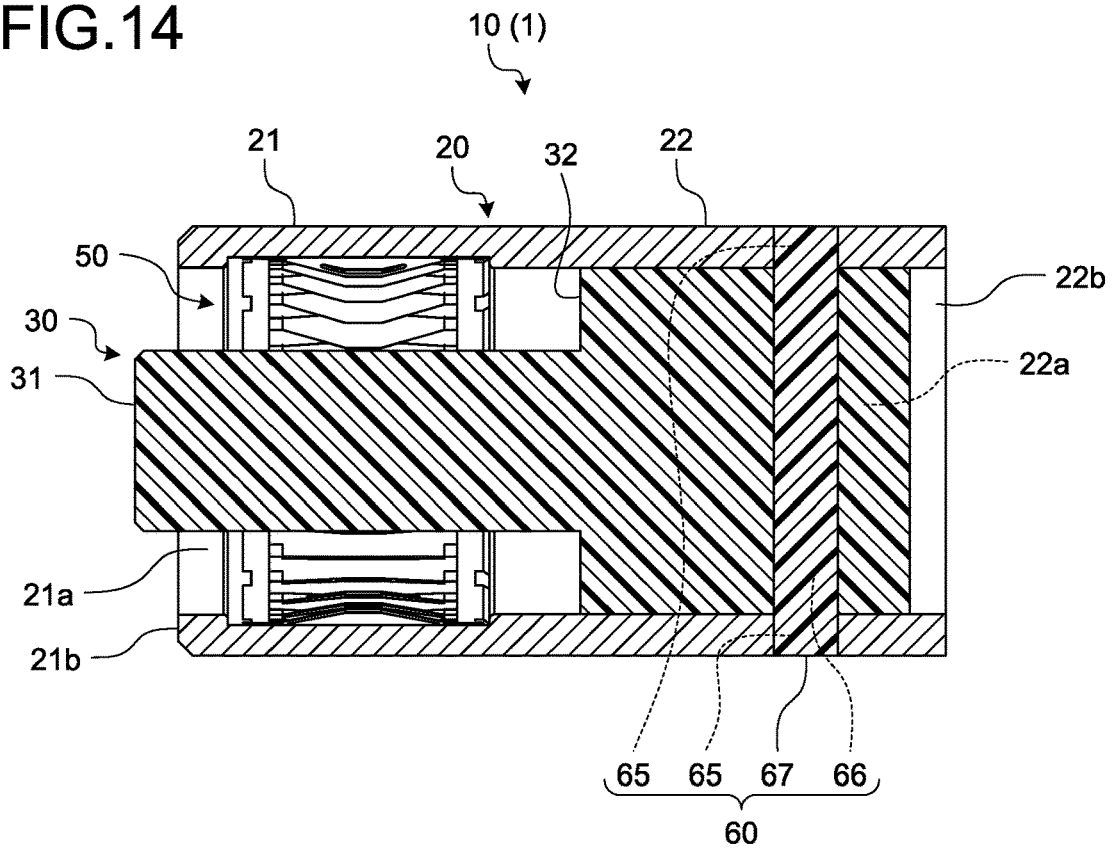
FIG. 14 is a cross-sectional view illustrating a deformed form of the fixing structure.

The fixing structure 60 may use the following configuration instead of the first fixing part 61 and the second fixing part 62. This fixing structure 60 includes a fixing through-hole 65 that is provided in the container 22, a fixing space part 66 that is provided in the object to be contained 32 so as to oppose the fixing through-hole 65 at the completely contained position, and a fixing member 67 to be inserted and fitted into the fixing through-hole 65 and the fixing space part 66 (FIG. 14). For example, two circular fixing through-holes 65 that are opposingly arranged in the radial direction while having the containing space part 22*a* therebetween, are formed in the container 22. Furthermore, in the object to be contained 32, columnar-shaped through-holes of which the openings are each arranged so as to oppose the two fixing through-holes 65, are formed as the fixing space part 66. The fixing member 67 is formed as a columnar-shaped pin member made of an insulating material such as synthetic resin, and one end thereof is inserted into one of the fixing through-holes 65, followed by insertion into the fixing space part 66 until this one end reaches the other fixing through-hole 65. The fixing member 67 is fitted into the two fixing through-holes 65 and the fixing space part 66. The female connector 10 can obtain the same effect as the previous exemplification even if the fixing structure 60 is replaced with such a configuration. Although the fixing member 67 that is made of an insulating material such as synthetic resin is exemplified here, the fixing member 67 may be formed as a columnar-shaped pin member made of a conductive material such as metal.

Meanwhile, in the female connector 10, it is desirable that a guide structure 70 that guides the object to be contained 32, which is inserted from the insertion opening 22*b* of the container 22 along the axis line direction, to the completely contained position, is provided between the container 22 and the object to be contained 32 (FIG. 9 to FIG. 13). The guide structure 70 includes a first guide part 71 that is provided in the container 22, and a second guide part 72 that is provided in the object to be contained 32. For example, either of the first guide part 71 and the second guide part 72 is formed as a guiding projection part that is projected in an orthogonal direction with respect to the axis line direction of the container 22 and the object to be contained 32. Furthermore, the other of the two is formed as a guide groove part that guides the guiding projection part to the completely contained position when the object to be contained 32 is inserted from the insertion opening 22*b* along the axis line direction. In this exemplification, the first guide part 71 is formed as the guide groove part, and the second guide part 72 is formed as the guiding projection part. Here, the female-side connecting body 21 and the container 22 are formed by bending a rectangular-shaped flat plate into a cylindrical shape. Thus, in this exemplification, two corner parts on the side that becomes the container 22 after the bending of the rectangular-shaped flat plate are notched in rectangular shapes, and the rectangular-shaped notches at the two positions are opposingly arranged in the circumferential direction after the bending of the flat plate. The first guide part 71 in this exemplification is formed by the opposingly arranged rectangular-shaped notches at the two positions.

In the female connector 10, the female-side insulating member 30 is inserted from the insertion opening 22*b* of the container 22 so as to allow the first guide part 71 to engage with the second guide part 72 (that is, so as to allow the second guide part 72 as the guiding projection part to be inserted into the first guide part 71 as the guide groove part). In this manner, in the female connector 10, no matter which configuration is applied to the fixing structure 60, the separately formed female terminal 20 and female-side insulating member 30 can be easily assembled such that the relative positional relation corresponds to the intended completely contained position. Accordingly, the female connector 10 can further improve the workability of assembling the female terminal 20 and the female-side insulating member 30.

In this regard, in the female connector 10, an annular body 42 having insulating property that is further projected than a tip surface 21*b* of the female-side connecting body 21 on the connector insertion direction side, on the same cylindrical axis is provided outside the female-side space part 21*a* in an orthogonal direction with respect to the cylindrical axis direction of the female-side connecting body 21 (FIG. 6 and FIG. 7). If the inner diameter of the annular body 42 is smaller than the size of a reference finger, the female connector 10 may cause the annular body 42 to provide a function of inhibiting finger contact to the female terminal 20. The reference finger is, for example, an articulated test finger of a protection level, IPXXB. However, the female connector 10 according to the present embodiment is configured so as to prevent fingers from touching the female terminal 20 with the finger touch preventing body 31 and the annular body 42, in consideration of a case in which the inhibition of finger contact to the female terminal 20 with the annular body 42 becomes difficult due to an increase of the body size in the radial direction.

Figure 15:
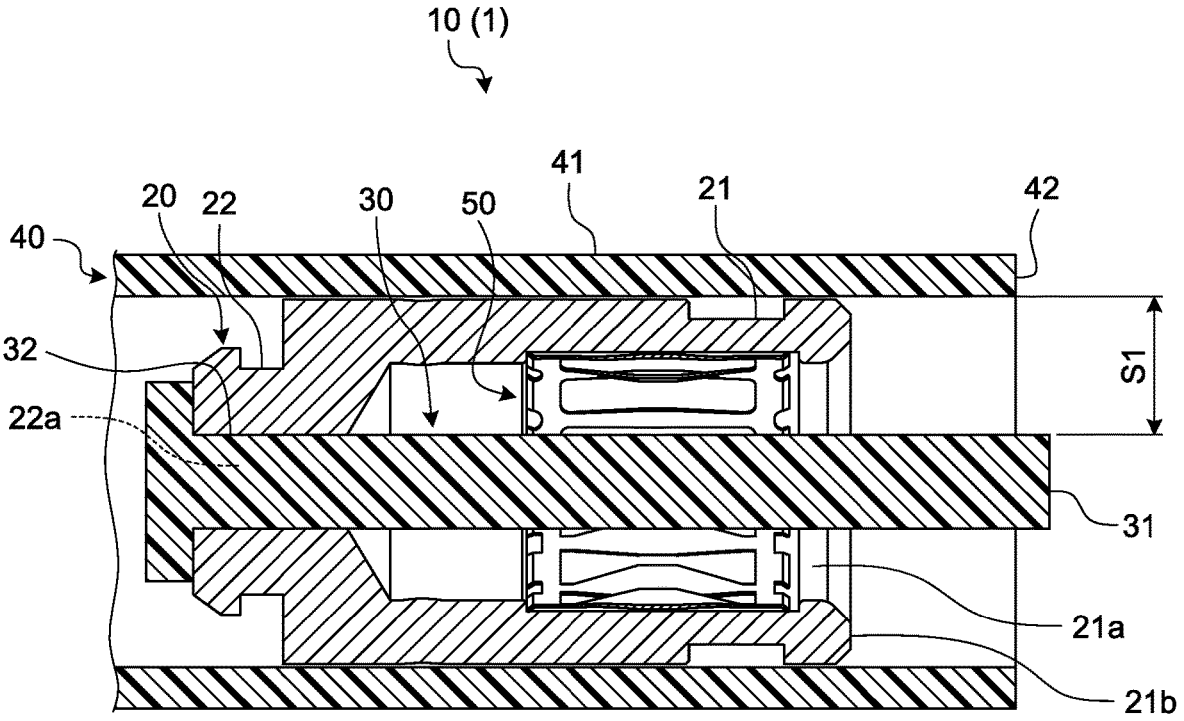
FIG. 15 is a cross-sectional view illustrating a deformed form of the female connector.

Thus, the finger touch preventing body 31 is further projected than the tip surface 21*b* of the female-side connecting body 21 on the connector insertion direction side, in the axis line direction (FIG. 6 and FIG. 7). The tip of the finger touch preventing body 31 on the connector insertion direction side is further projected than the tip surface 21*b*. By configuring the female connector 10 such that the finger touch preventing body 31 and the annular body 42 prevent fingers from reaching the female terminal 20, even if the body size is increased in the radial direction due to large current for example, finger contact to the female terminal 20 can be inhibited. Here, an interval S1 (FIG. 6) in the orthogonal direction between the finger touch preventing body 31 and the annular body 42 (the orthogonal direction with respect to the cylindrical axis direction of the female-side connecting body 21) is made narrower than the size of the reference finger. For example, in the female connector 10, the outer diameter of the finger touch preventing body 31 is determined so as to achieve the interval S1. In addition, if there is a limitation on the increase of the outer diameter of the finger touch preventing body 31, the projection amount of the tip of the finger touch preventing body 31 may be increased so as to prevent fingers from reaching the female terminal 20 with the finger touch preventing body 31 and the annular body 42 (FIG. 15). In this case, the projection amount of the annular body 42 from the tip surface 21*b* is also increased. For example, with regard to the annular body 42, its projection amount is increased by an amount equivalent to that of the tip of the finger touch preventing body 31.

Furthermore, the female connector 10 causes the finger touch preventing body 31 to be inserted, from its tip, into the first space part 131*b* of the outer cylindrical body 131 in the male-side insulating member 130 before the start of insertion and fitting between the female terminal 20 and the male terminal 120, when performing insertion and fitting with respect to the male connector 110, by causing the tip of the finger touch preventing body 31 on the connector insertion direction side to further project than the tip surface 21*b* of the female-side connecting body 21. Accordingly, the female connector 10 includes an aligning function at the time of insertion and fitting with respect to the male connector 110, by having the finger touch preventing body 31 in which its tip is projected. In order to obtain the aligning function, the female connector 10 may, for example, further project the tip of the finger touch preventing body 31 than the annular body 42 in the axis line direction such that the insertion between the finger touch preventing body 31 and the outer cylindrical body 131 starts before the start of the insertion between other objects to be inserted. In addition, in order to obtain the aligning function, the female connector 10 may, for example, cause the insertion between the finger touch preventing body 31 and the outer cylindrical body 131 and the insertion between a female-side fitting part 41 and a male-side fitting part 141, which will be described later, to start at the same time.

The annular body 42 in this exemplification is provided in the female-side fitting part 41, which will be described later, of the female housing 40.

The female housing 40 is made of an insulating material such as synthetic resin. The female-side fitting part 41 having a cylindrical shape that contains the female terminal 20 in the inside to cover this from the outside, is formed in the female housing 40 (FIG. 6 and FIG. 7). The female-side fitting part 41 is inserted into and fitted with the male-side fitting part 141, which will be described later, of the male housing 140 on the same cylindrical axis. In the female-side fitting part 41, an annular tip on the connector insertion direction side (an end part on the connector insertion direction side) is utilized as the annular body 42. Thus, the tip of the female-side fitting part 41 is further projected than the tip surface 21*b* of the female-side connecting body 21 on the connector insertion direction side, in the cylindrical axis direction.

The following describes the male connector 110.

The male connector 110 includes, besides the male terminal 120 and the male-side insulating member 130, the male housing 140 that contains them (FIG. 6 and FIG. 7).

Figure 5:
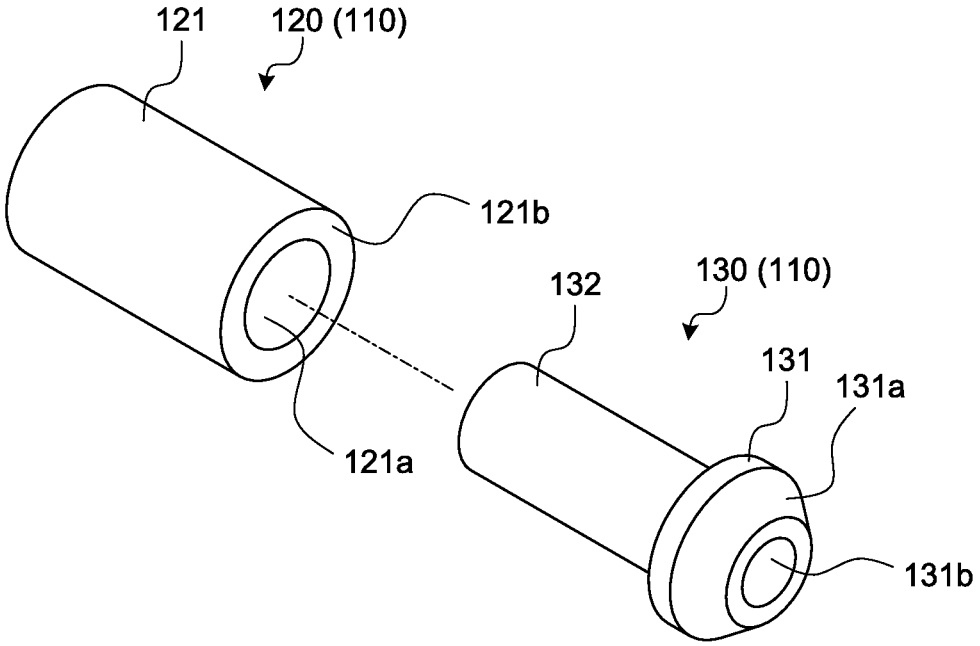
FIG. 5 is an exploded perspective view of a male connector.

The male terminal 120 is made of a conducting material such as metal. The male terminal 120 has the male-side connecting body 121 having a cylindrical shape to be inserted into and fitted with the female-side space part 21*a* of the female-side connecting body 21 on the same cylindrical axis (FIG. 5 to FIG. 7). The male-side connecting body 121 has the male-side space part 121*a* therein. In this exemplification, the male-side connecting body 121 is formed in a cylindrical shape.

The male-side insulating member 130 is made of an insulating material such as synthetic resin. The male-side insulating member 130 is a member for preventing fingers from touching the tip of the male terminal 120 on the connector insertion direction side. The male-side insulating member 130 prevents fingers from touching the male terminal 120, in conjunction with the male housing 140. The male-side insulating member 130 has the outer cylindrical body 131 having a cylindrical shape that covers an annular tip surface 121*b* of the male-side connecting body 121 on the connector insertion direction side, on the same cylindrical axis (FIG. 1, and FIG. 5 to FIG. 7). In this exemplification, the outer cylindrical body 131 is formed in a cylindrical shape.

The outer cylindrical body 131 is inserted into the female-side space part 21*a* of the female-side connecting body 21, together with the male-side connecting body 121. Thus, the outer cylindrical body 131 is formed to have, for example, the same outer diameter as the male-side connecting body 121 so as not to inhibit the insertion operation. In the outer cylindrical body 131, it is desirable that an annular chamfered part 131*a* (FIG. 1, FIG. 2, FIG. 5, and FIG. 6) along the circumferential direction is provided at its tip on the connector insertion direction side, so as to facilitate the insertion into the female-side space part 21*a*. The chamfered part 131*a* may be a curved surface or flat surface. The chamfered part 131*a* in this exemplification is formed in a tapered shape.

In addition, the finger touch preventing body 31 is inserted into the first space part 131*b* (FIG. 1, and FIG. 5 to FIG. 7), which is formed inside the outer cylindrical body 131. Thus, the outer cylindrical body 131 is formed to have the first space part 131*b* so as not to inhibit the insertion operation.

In this regard, as previously described, the finger touch preventing body 31 is also inserted into the male-side space part 121*a* of the male-side connecting body 121. In a conventional fitting connector, the inner diameter of the male-side connecting body 121 and the inner diameter of the outer cylindrical body 131 are formed in the same size, and thus the finger touch preventing body 31 may contact the male-side connecting body 121. The fitting connector 1 in the present embodiment is configured such that a contact between the finger touch preventer 31 and the male-side connecting body 121 does not occur. In this regard, for convenience of explanation, the conventional fitting connector is described by providing the same reference signs as those in the configuration of the fitting connector 1 in the present embodiment.

Here, the inner cylindrical body 132 having insulating property and a cylindrical shape is inserted into the male-side space part 121*a* (FIG. 2, and FIG. 5 to FIG. 7), and the inner cylindrical body 132 is interposed between the finger touch preventing body 31 and the male-side connecting body 121, thereby inhibiting a contact therebetween. The inner cylindrical body 132 is inserted into the male-side space part 121*a* on the same cylindrical axis. The finger touch preventing body 31 is inserted into the second space part 132*a* (FIG. 2, FIG. 6, and FIG. 7), which is formed inside the inner cylindrical body 132, after passing through the first space part 131*b* of the outer cylindrical body 131. In this exemplification, the inner cylindrical body 132 is formed in a cylindrical shape.

Since the inner cylindrical body 132 is interposed between the finger touch preventing body 31 and the male-side connecting body 121 in such a manner, the fitting connector 1 can inhibit a contact between the finger touch preventing body 31 and the male-side connecting body 121 when the male terminal 120 is inserted into and extracted from the female terminal 20, and also when the female terminal 20 and the male terminal 120 are in the inserted and fitted state.

For example, in the conventional fitting connector, when the finger touch preventing body 31, which is softer as compared to the male-side connecting body 121, is inserted into the male-side space part 121*a*, if the finger touch preventing body 31 contacts a corner part of the male-side connecting body 121 on the inner peripheral surface side and the outer cylindrical body 131 side, the finger touch preventing body 31 may be scraped by the corner part. Furthermore, in the conventional fitting connector, if shavings of the finger touch preventing body 31 go into a space between the female terminal 20 and the male terminal 120 in accordance with vibration or the like during use, conduction failure may be caused therebetween. However, the fitting connector 1 in the present embodiment can suppress generation of such shavings of the finger touch preventing body 31, and can improve durability of the finger touch preventing body 31. Furthermore, as a result, the fitting connector 1 in the present embodiment can suppress degradation of conduction performance between the female terminal 20 and the male terminal 120, and therefore, the performance as a connector that electrically connects female and male terminals can be continuously maintained.

The inner cylindrical body 132 having such a function may be prepared as a separate part from the outer cylindrical body 131. However, in order to realize decrease of the number of parts, and improvement of assembling workability, reduction of cost, and the like associated therewith, it is desirable that the inner cylindrical body 132 and the outer cylindrical body 131 are integrated. In other words, the inner cylindrical body 132 is desirably provided as one part of the male-side insulating member 130. Thus, the male-side insulating member 130 in the present embodiment causes the inner cylindrical body 132 to project from the outer cylindrical body 131 on the same cylindrical axis.

For example, the male-side insulating member 130 may be integrally formed (e.g., insert molding) with the male terminal 120 that is placed in a mold. In addition, the male-side insulating member 130 may be formed separately from the male terminal 120, and assembly with the male terminal 120 may be performed by inserting the inner cylindrical body 132 into the male-side space part 121*a* of the male-side connecting body 121. At the time of the assembly, for example, the inner cylindrical body 132 is fitted into the male-side space part 121*a*.

In addition, the length of the inner cylindrical body 132 in the cylindrical axis direction is desirably set to a length that causes the tip of the finger touch preventing body 31 on the connector insertion direction side to be arranged in the second space part 132*a* when the female-side connecting body 21 and the male-side connecting body 121 are in the inserted and fitted state. In this manner, in both cases where the inner cylindrical body 132 is prepared as a separate part from the male-side insulating member 130 and where the inner cylindrical body 132 is prepared as one part of the male-side insulating member 130, the fitting connector 1 can suppress a deflection of the tip of the finger touch preventing body 31, and thus the contact inhibition effect between the finger touch preventing body 31 and the male-side connecting body 121 can be enhanced.

In the male connector 110, an annular body 142 having insulating property is provided outside the outer cylindrical body 131 in an orthogonal direction with respect to the cylindrical axis direction of the outer cylindrical body 131 with an interval, on the same cylindrical axis as the outer cylindrical body 131 (FIG. 6 and FIG. 7). The male connector 110 is configured such that the outer cylindrical body 131 and the annular body 142 prevent fingers from touching the male terminal 120. In this embodiment, an interval (an interval in the orthogonal direction with respect to the cylindrical axis direction) S2 (FIG. 6) between the outer cylindrical body 131 and the annular body 142 is made narrower than the size of a reference finger so as to prevent fingers from touching the male terminal 120. The reference finger is, for example, the articulated test finger of the protection level, IPXXB, which was previously described.

The annular body 142 in this exemplification is provided in the male-side fitting part 141, which will be described later, of the male housing 140.

The male housing 140 is made of an insulating material such as synthetic resin. The male-side fitting part 141 having a cylindrical shape that contains the male terminal 120 therein to cover this from the outside with an interval, is formed in the male housing 140 (FIG. 6 and FIG. 7). In the male connector 110, a cylindrical space part is formed between the male terminal 120 and the male-side fitting part 141. With respect to the cylindrical space part, the female-side connecting body 21 of the female terminal 20 and the female-side fitting part 41 of the female housing 40 are inserted on the same cylindrical axis. In the male-side fitting part 141, an annular tip on the connector insertion direction side (an end part on the connector insertion direction side) is utilized as the annular body 142. Thus, the male-side fitting part 141 is further projected than the tip surface 121*b* of the male-side connecting body 121 on the connector insertion direction side, in the cylindrical axis direction.

As described above, the fitting connector 1 in the present embodiment can prevent fingers from contacting the female terminal 20 and the male terminal 120. For example, regardless of its body size in the radial direction, the female connector 10 in the present embodiment can inhibit finger contact to the female terminal 20 with the finger touch preventing body 31 and the annular body 42, which are further projected than the tip surface 21*b* of the female-side connecting body 21. In addition, even if the female terminal 20 and the female-side insulating member 30 are formed as separate members, in the female connector 10 in the present embodiment, the female terminal 20 and the female-side insulating member 30 can be assembled such that the relative positional relation corresponds to the intended completely contained position, by providing the fixing structure between the container 22 of the female terminal 20 and the object to be contained 32 of the female-side insulating member 30. In this manner, the female connector 10 can ensure the finger touch prevention function with respect to the female terminal 20.

Furthermore, the fitting connector 1 in the present embodiment can not only prevent fingers from touching the female terminal 20 and the male terminal 120, but can also suppress degradation of conduction performance between the female terminal 20 and the male terminal 120 with the function of inhibiting a contact between the finger touch preventing body 31 and the male-side connecting body 121 exerted by the inner cylindrical body 132, while ensuring the finger touch prevention function.

Furthermore, the female connector 10 in the present embodiment can obtain the aligning function at the time of insertion and fitting with respect to the male connector 110 using the finger touch preventing body 31, while ensuring the finger touch prevention function with respect to the female terminal 20. In other words, the female connector 10 can cause the finger touch preventing body 31 to exert both the finger touch prevention function with respect to the female terminal 20 and the aligning function at the time of connector fitting. The aligning function becomes more effective by causing the tip of the finger touch preventing body 31 to further project than the tip surface 21*b* of the female-side connecting body 21. In addition, the aligning function becomes more effective in conjunction with the effect exerted by the fixing function of the fixing structure 60. Since the fitting connector 1 in the present embodiment includes the female connector 10, it can obtain these effects exerted by the female connector 10.

Furthermore, even if the female terminal 20 and the female-side insulating member 30 are formed as separate members, the female connector 10 in the present embodiment can improve the workability of assembling the female terminal 20 and the female-side insulating member 30 by providing the fixing structure 60 between the container 22 of the female terminal 20 and the object to be contained 32 of the female-side insulating member 30. Since the fitting connector 1 in the present embodiment includes the female connector 10, it can obtain this effect exerted by the female connector 10.

In the fitting connector according to the present embodiment, the inner cylindrical body is interposed between the finger touch preventing body and the male-side connector. Thus, a contact between the finger touch preventing body and the male-side connector can be inhibited when the male terminal is inserted into and extracted from the female terminal, and also when the female terminal and the male terminal are in the inserted and fitted state. In this manner, the fitting connector can suppress the generation of shavings of the finger touch preventing body, and can improve the durability of the finger touch preventing body. Therefore, degradation of conduction performance between the female terminal and the male terminal can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fitting connector comprising:

a female connector that is provided with a female terminal and a female-side insulating member having insulating property; and a male connector that is provided with a male terminal and a male-side insulating member having insulating property, wherein the female terminal has a female-side connecting body having a cylindrical shape, where a female-side space part is formed inside, the male terminal has a male-side connecting body having a cylindrical shape to be inserted into and fitted with the female-side space part on a same cylindrical axis, the male-side insulating member has an outer cylindrical body having a cylindrical shape that covers a tip surface of the male-side connecting body on a connector insertion direction side, on the same cylindrical axis, the male-side connecting body has, in inside thereof, a male-side space part into which an inner cylindrical body having a cylindrical shape and insulating property is inserted on the same cylindrical axis, and the female-side insulating member has a finger touch preventing body having a columnar or cylindrical shape that is arranged in the female-side space part on the same axis line as the cylindrical axis of the female-side space part, and that is inserted into a first space part formed inside the outer cylindrical body and a second space part formed inside the inner cylindrical body, when the female-side connecting body and the male-side connecting body are in an inserted and fitted state.

2. The fitting connector according to claim 1, wherein the finger touch preventing body is further projected than the tip surface of the female-side connecting body on the connector insertion direction side, in the axis line direction, and in the female connector, an annular body having insulating property that is further projected than the tip surface of the female-side connecting body on the same cylindrical axis is provided outside the female-side space part in an orthogonal direction with respect to the cylindrical axis direction of the female-side connecting body.

3. The fitting connector according to claim 1, wherein a length of the inner cylindrical body in the cylindrical axis direction is a length that causes a tip of the finger touch preventing body on the connector insertion direction side to be arranged in the second space part when the female-side connecting body and the male-side connecting body are in the inserted and fitted state.

4. The fitting connector according to claim 3, wherein the finger touch preventing body is further projected than the tip surface of the female-side connecting body on the connector insertion direction side, in the axis line direction, and in the female connector, an annular body having insulating property that is further projected than the tip surface of the female-side connecting body on the same cylindrical axis is provided outside the female-side space part in an orthogonal direction with respect to the cylindrical axis direction of the female-side connecting body.

5. The fitting connector according to claim 1, wherein the inner cylindrical body is integrated with the outer cylindrical body.

6. The fitting connector according to claim 5, wherein the finger touch preventing body is further projected than the tip surface of the female-side connecting body on the connector insertion direction side, in the axis line direction, and in the female connector, an annular body having insulating property that is further projected than the tip surface of the female-side connecting body on the same cylindrical axis is provided outside the female-side space part in an orthogonal direction with respect to the cylindrical axis direction of the female-side connecting body.

7. The fitting connector according to claim 5, wherein a length of the inner cylindrical body in the cylindrical axis direction is a length that causes a tip of the finger touch preventing body on the connector insertion direction side to be arranged in the second space part when the female-side connecting body and the male-side connecting body are in the inserted and fitted state.

8. The fitting connector according to claim 7, wherein the finger touch preventing body is further projected than the tip surface of the female-side connecting body on the connector insertion direction side, in the axis line direction, and in the female connector, an annular body having insulating property that is further projected than the tip surface of the female-side connecting body on the same cylindrical axis is provided outside the female-side space part in an orthogonal direction with respect to the cylindrical axis direction of the female-side connecting body.

* * * * *